US010804014B2

(12) United States Patent
Kuse et al.

(10) Patent No.: US 10,804,014 B2
(45) Date of Patent: Oct. 13, 2020

(54) FLAT SOFT MAGNETIC POWDER AND PRODUCTION METHOD THEREFOR

(71) Applicant: Sanyo Special Steel Co., Ltd., Himeji-shi (JP)

(72) Inventors: Tetsuji Kuse, Himeji (JP); Kodai Miura, Himeji (JP); Fumihiro Maezawa, Himeji (JP); Toshiyuki Sawada, Himeji (JP)

(73) Assignee: Sanyo Special Steel Co., Ltd., Himeji-shi (JP)

( * ) Notice: Subject to any disclaimer, the term of this patent is extended or adjusted under 35 U.S.C. 154(b) by 623 days.

(21) Appl. No.: 15/445,270

(22) Filed: Feb. 28, 2017

(65) Prior Publication Data

US 2017/0256345 A1 Sep. 7, 2017

(30) Foreign Application Priority Data

Mar. 1, 2016 (JP) ..... 2016-038637

(51) Int. Cl.

| | |
|---|---|
| ***H01F 1/147*** | (2006.01) |
| ***B22F 1/00*** | (2006.01) |
| ***B22F 9/04*** | (2006.01) |
| ***B22F 9/08*** | (2006.01) |
| ***B22F 9/10*** | (2006.01) |
| ***C21D 6/00*** | (2006.01) |
| ***C22C 38/02*** | (2006.01) |
| ***C22C 38/06*** | (2006.01) |
| ***H01F 1/16*** | (2006.01) |
| *H01F 1/26* | (2006.01) |

(52) U.S. Cl.

CPC ..... *H01F 1/14791* (2013.01); *B22F 1/0055* (2013.01); *B22F 9/04* (2013.01); *B22F 9/082* (2013.01); *B22F 9/10* (2013.01); *C21D 6/008* (2013.01); *C22C 38/02* (2013.01); *C22C 38/06* (2013.01); *H01F 1/16* (2013.01); *B22F 2009/0828* (2013.01); *B22F 2009/0848* (2013.01); *B22F 2301/35* (2013.01); *B22F 2304/10* (2013.01); *B22F 2998/10* (2013.01); *C22C 2202/02* (2013.01); *H01F 1/26* (2013.01)

(58) Field of Classification Search

CPC ..... H01F 1/14791; H01F 1/16; H01F 1/26; B22F 1/0055; B22F 9/04; B22F 9/082; B22F 9/10; B22F 2009/0828; B22F 2009/0848; B22F 2301/35; B22F 2304/10; B22F 2998/10; C21D 6/008; C22C 38/02; C22C 38/06; C22C 2202/02

See application file for complete search history.

(56) References Cited

U.S. PATENT DOCUMENTS

| | | | | |
|---|---|---|---|---|
| 8,038,808 | B2 | 10/2011 | Matsukawa et al. | |
| 8,350,559 | B2 | 1/2013 | Fukushima | |
| 2006/0151068 | A1* | 7/2006 | Lee | H01F 1/14791 148/104 |
| 2010/0001226 | A1* | 1/2010 | Aramaki | B22F 3/22 252/62.55 |

FOREIGN PATENT DOCUMENTS

| | | | |
|---|---|---|---|
| JP | 2008115404 | A * | 5/2008 |
| JP | 4636113 | B2 | 2/2011 |
| JP | 201122661 | A | 2/2011 |
| JP | 2012136770 | A * | 7/2012 |

OTHER PUBLICATIONS

Zenichem Trading Co http://zenichem.co.kr/images/contents/pro_pdf/C1F-01-06(Flaked).pdf Aug. 23, 2015(C1 F-04). (Year: 2015).*

* cited by examiner

*Primary Examiner* — John A Hevey
(74) *Attorney, Agent, or Firm* — The Webb Law Firm

(57) ABSTRACT

Provided is a flaky soft magnetic powder composed of an Fe—Si—Al alloy containing Si: 5.5 to 10.5 mass %, Al: 4.5 to 8.0 mass %, and Fe and incidental impurities: balance, wherein the flaky powder exhibits a ratio ($D_{50}$/TD) of 35 to 92 where $D_{50}$ represents the average particle size (μm) of the powder and TD represents the tap density (Mg/m$^3$) of the powder, and the flaky powder exhibits a coercive force of 239 to 479 A/m as measured under application of a magnetic field in an in-plane direction of the flaky powder. The flaky soft magnetic powder exhibits superior sheet formability and has high magnetic permeability.

5 Claims, No Drawings

FLAT SOFT MAGNETIC POWDER AND PRODUCTION METHOD THEREFOR

CROSS-REFERENCE TO RELATED APPLICATION

This application claims priority to Japanese Patent Application No. 2016-038637 filed on Mar. 1, 2016, the entire disclosure of which is incorporated herein by reference.

TECHNICAL FIELD

The present invention relates to a flaky soft magnetic powder for use in an antenna for 10 MHz or thereabouts, such as an antenna for radio frequency identification (RFID). The present invention also relates to a method of producing the flaky soft magnetic powder.

BACKGROUND ART

Magnetic sheets containing flaky soft magnetic powder have been used in electromagnetic wave absorbers and antennas for RFID. In recent years, such a magnetic sheet has also been used in a position detecting device, which is called "digitizer." JP2011-22661A (Patent Document 1) discloses an electromagnetic induction-type digitizer including a pen-shaped position indicator and a panel-shaped position detector wherein a high-frequency signal transmitted from a coil embedded in the tip of the position indicator is read by a loop coil embedded in the position detector, to detect the indicated position. A sheet serving as a magnetic path for the high-frequency signal is disposed behind the loop coil for enhancing the detection sensitivity. The magnetic path sheet is composed of, for example, a magnetic sheet prepared by orientation of flaky soft magnetic powder in a resin or a rubber, or a sheet prepared by bonding of soft magnetic amorphous alloy foils. In the case of the use of such a magnetic sheet, the entire detection panel can be composed of a single sheet. Thus, the magnetic sheet exhibits detection uniformity superior to that of the sheet of amorphous alloy foil, which may cause poor detection at the bonding portion.

A traditional magnetic sheet contains powder of an Fe—Si—Al, Fe—Si, Fe—Ni, Fe—Al, or Fe—Cr alloy flattened with, for example, an attrition mill (attritor) for the following reasons. As indicated by the "Ollendorff formula," the preparation of a magnetic sheet having high magnetic permeability requires the use of soft magnetic powder having high magnetic permeability, the use of flaky powder having a high aspect ratio in a direction of magnetization for reducing demagnetizing field, and the filling of the magnetic sheet with soft magnetic powder at high density. Japanese Patent No. 4636113 (Patent Document 2) discloses a method of producing a flaky soft magnetic powder having a large major-axis length and a high aspect ratio, the method involving flattening of powder in the presence of a monohydric alcohol having two to four carbon atoms.

CITATION LIST

Patent Documents

Patent Document 1: JP2011-22661A
Patent Document 2: Japanese Patent No. 4636113

SUMMARY OF INVENTION

The aforementioned digitizer has been applied to mobile electronic devices, such as smartphones and tablets. Keen demand has arisen for reducing the size of such a mobile electronic device and the thickness of a magnetic sheet serving as a magnetic path sheet. For example, a magnetic sheet having a thickness of about 50 μm or less has been used. A tablet having a 10-inch liquid crystal display has been developed, and a magnetic sheet used in such a tablet has been required to have a large area. The preparation of such a thin magnetic sheet by a common process (e.g., rolling or pressing) involves a problem in terms of the sheet formability of raw material powder, which causes no problem in the preparation of a traditional thick magnetic sheet.

In many cases, a thin magnetic sheet having a thickness of 50 μm or less is not successfully formed from flaky soft magnetic powder having an excessively large major-axis length because of poor alignment of the powder and sparse and dense portions formed in the powder. Attempts have been made to address such problems during formation of the sheet by a process involving low filling ratio of the powder for preparation of the sheet, or a process involving pressing of the formed sheet. Unfortunately, the former process leads to a reduction in the magnetic permeability of the sheet, resulting in poor performance of the sheet, whereas the latter process leads to application of a large stress to the powder in the sheet, resulting in introduction of strain into the powder. The introduction of strain increases the coercive force Hc of the powder and reduces the magnetic permeability of the powder, resulting in poor performance of the sheet. Thus, difficulty is encountered in forming a magnetic sheet from flaky soft magnetic powder having a large average particle size $D_{50}$ as disclosed in Patent Document 2.

An object of the present invention is to provide a flaky soft magnetic powder exhibiting superior sheet formability and having high magnetic permeability. Another object of the present invention is to provide a method of producing the flaky soft magnetic powder.

An aspect of the present invention provides a flaky soft magnetic powder comprising an Fe—Si—Al alloy containing Si: 5.5 to 10.5 mass %, Al: 4.5 to 8.0 mass %, and Fe and incidental impurities: balance, wherein the flaky powder exhibits a ratio ($D_{50}$/TD) of 35 to 92 where $D_{50}$ represents the average particle size (μm) of the powder and TD represents the tap density (Mg/m$^3$) of the powder, and the flaky powder exhibits a coercive force of 239 to 479 A/m as measured under application of a magnetic field in an in-plane direction of the flaky powder.

The use of the flaky soft magnetic powder satisfying the aforementioned conditions can produce an antenna for 10 MHz or thereabouts (e.g., an antenna for RFID) wherein the magnetic permeability μ has a large real part μ' and a small imaginary part μ". A large real part μ' leads to an increase in communication range, whereas a small imaginary part μ" leads to a reduction in energy loss. The magnetic permeability μ can be represented by a complex magnetic permeability ($\mu=\mu'-j\mu''$). An increase in the maximum real part μ' is likely to lead to an increase in imaginary part μ".

Another aspect of the present invention provides a method of producing the flaky soft magnetic powder, the method comprising the steps of:

preparing a raw material powder by any process selected from water atomization, gas atomization, disk atomization, and grinding after melt-alloying;

flattening the raw material powder; and heat-treating the flattened powder at 200 to 500° C. under vacuum or in an argon or nitrogen atmosphere.

DESCRIPTION OF EMBODIMENTS

Flaky Soft Magnetic Powder

The flaky soft magnetic powder of the present invention is composed of an Fe—Si—Al alloy containing Si, Al, and Fe and incidental impurities (balance). The Si content is preferably 5.5 to 10.5 mass %, more preferably 6.5 to 9.5 mass %. An Si content of less than 5.5 mass % leads to a very high magnetocrystalline anisotropy constant, resulting in reduced magnetic permeability of the magnetic sheet. An Si content exceeding 10.5 mass % leads to a very high hardness of particles of the powder. This excessively promotes the miniaturization of crystal grains during the flattening of the powder, resulting in an increase in the coercive force of the powder and thus a reduction in the magnetic permeability of the magnetic sheet. The Al content is preferably 4.5 to 8.0 mass %, more preferably 5.5 to 7.0 mass %. An Al content of less than 4.5 mass % leads to a very high magnetocrystalline anisotropy constant, resulting in reduced magnetic permeability of the magnetic sheet. An Al content exceeding 8.0 mass % leads to a very low saturation magnetic flux density of the flaky powder, resulting in reduced magnetic permeability of the magnetic sheet.

The flaky soft magnetic powder has an average particle size $D_{50}$ of preferably 35 to 55 μm, more preferably 40 to 50 μm. An average particle size $D_{50}$ of 35 μm or more leads to a high aspect ratio of the flaky powder. This prevents a reduction in real part μ' of magnetic permeability and further improves the magnetic permeability of the magnetic sheet. An average particle size $D_{50}$ of 55 μm or less can prevent impairment of the formability of the magnetic sheet. In particular, the average particle size is preferably 55 μm or less in view of the performance and production cost of the magnetic sheet. If the average particle size is 55 μm or less, the resultant magnetic sheet has small surface irregularities; i.e., no special treatment is required for preventing the surface irregularities.

The flaky soft magnetic powder has a tap density TD of preferably 0.6 to 1.0 $Mg/m^3$, more preferably 0.7 to 0.9 $Mg/m^3$. The tap density tends to monotonically decrease with the progress of the process. A tap density of 0.6 $Mg/m^3$ or more leads to shortening of the period of the flattening step, resulting in reduced production cost, and also prevents a decrease in average particles size and an increase in coercive force. A tap density of 1.0 $Mg/m^3$ or less leads to prevention of an excessive increase in average particle size. Thus, the filling ratio of the flaky powder increases in the magnetic sheet, and the magnetic permeability μ of the magnetic sheet is further improved. The flaky soft magnetic powder produced under the aforementioned conditions exhibits superior sheet formability and high magnetic permeability.

In the flaky soft magnetic powder of the present invention, the ratio of the average particle size $D_{50}$ (μm) to the tap density TD ($Mg/m^3$) (i.e., $D_{50}/TD$) is preferably 35 to 92, more preferably 35 to 80, most preferably 40 to 60. A ratio $D_{50}/TD$ of less than 35 leads to low aspect ratio of the flaky powder and low filling ratio of the powder in the magnetic sheet, resulting in reduced magnetic permeability μ of the magnetic sheet. A ratio $D_{50}/TD$ exceeding 92 leads to high aspect ratio of the flaky powder and high filling ratio of the powder in the magnetic sheet, which may result in poor formability of the magnetic sheet.

The flaky soft magnetic powder exhibits a coercive force Hc of preferably 239 to 479 A/m, more preferably 319 to 439 A/m as measured under application of a magnetic field in an in-plane direction of the flaky powder. A coercive force Hc of less than 239 A/m leads to a large imaginary part μ" of complex magnetic permeability (μ=μ"-jμ") in a low frequency band, resulting in increased energy loss. A coercive force Hc exceeding 479 A/m leads to a small real part μ' of complex magnetic permeability (μ=μ'-jμ"), resulting in poor antenna performance.

The coercive force of the flaky soft magnetic powder as measured under application of a magnetic field in a thickness direction of the flaky powder is preferably 2 to 4.5 times, more preferably 2 to 3.5 times, still more preferably 2 to 3 times, the coercive force of the flaky soft magnetic powder as measured under application of a magnetic field in an in-plane direction of the flaky powder. If the ratio of the coercive force in the thickness direction to that in the in-plane direction is 2 or more, the magnetic permeability further increases, whereas if the ratio is 4.5 or less, the sheet formability, which may be impaired by surface protrusions, is maintained.

The flaky soft magnetic powder exhibits a half width of the strongest XRD peak (2θ=44±2° of preferably 0.3 to 0.6°, more preferably 0.4 to 0.5°. A half width of 0.3° or more indicates prevention of a reduction in coercive force Hc caused by excessive heat-treatment. This results in a small imaginary part μ" of complex magnetic permeability (μ=μ'-jμ") and reduced energy loss. A half width of 0.6° or less indicates sufficient recovery of lattice defects generated in the powder flattened with an attritor. This results in a large real part μ' and satisfactory antenna performance.

Method of Producing Flaky Soft Magnetic Powder

The method of producing the flaky soft magnetic powder of the present invention involves a step of preparing soft magnetic alloy powder (raw material powder) by, for example, atomization; a step of flattening the raw material powder; and a step of heat-treating the flattened powder under vacuum or in an inert gas atmosphere.

(1) Step of Preparing Raw Material Powder

The flaky soft magnetic powder of the present invention can be prepared by flattening of soft magnetic alloy powder. The soft magnetic alloy powder preferably has high saturation magnetization. In general, an Fe—Si—Al alloy is superior in coercive force and saturation magnetization.

The soft magnetic alloy powder is prepared by any process selected from atomization (e.g., water atomization, gas atomization, or disk atomization) and grinding after melt-alloying. The soft magnetic alloy powder preferably has a low oxygen content. Thus, the soft magnetic alloy powder is preferably prepared by gas atomization, more preferably prepared by use of an inert gas. Although disk atomization can provide the soft magnetic alloy powder without causing any problem, gas atomization is more preferred from the viewpoint of mass productivity.

The flaky powder of the present invention is readily produced by water atomization, gas atomization, disk atomization and/or grinding after melt-alloying. The powder prepared by atomization, which has a substantially spherical shape, is more readily flattened than ground by an attritor treatment. The powder prepared by grinding has a particle size smaller than that of the powder prepared by atomization, and thus barely forms protrusions on the surface of the magnetic sheet.

The soft magnetic alloy powder may have any particle size. The soft magnetic alloy powder may be subjected to classification for adjustment of the average particle size after flattening, removal of particles having high oxygen content, or other productive purposes.

(2) Flattening Step

The soft magnetic alloy powder is then flattened. The powder may be flattened by any known technique using an attritor, a ball mill, a vibration mill or the like. Particularly preferred is an attritor, which has a relatively high ability to flatten the powder. In the case of dry flattening, an inert gas is preferably used. In the case of wet flattening, an organic solvent is preferably used. The organic solvent may be of any type.

The organic solvent is added in an amount of preferably 100 parts by mass or more, more preferably 200 parts by mass or more, relative to 100 parts by mass of the soft magnetic alloy powder. The maximum amount of the organic solvent may be any value. The amount of the organic solvent may be appropriately adjusted in consideration of the balance between productivity and the intended size and shape of the flaky powder. The water content of the organic solvent is preferably 0.002 parts by mass or less relative to 100 parts by mass of the organic solvent for a reduction in the oxygen content of the flaky powder. The organic solvent may be used in combination with a flattening aid. The amount of the flattening aid is preferably 5 parts by mass or less relative to 100 parts by mass of the soft magnetic alloy powder for preventing oxidation.

(3) Heat-Treatment Step

The flattened soft magnetic powder is then heat-treated. The apparatus for heat-treatment may be of any type. The heat-treatment temperature is preferably 200° C. to 500° C., more preferably 350 to 450° C. The heat-treatment performed within such a temperature range can produce flaky soft magnetic powder having reduced coercive force and high magnetic permeability. The heat-treatment is performed for recovering lattice defects generated in the powder flattened with an attritor and reducing the coercive force of the powder. Thus, a temperature lower than 200° C. is insufficient for the heat-treatment. In contrast, the heat-treatment at a temperature exceeding 500° C. may cause sintering of a certain composition of materials, and the resultant coarse lumps may form numerous protrusions on the surface of the sheet. The flattened powder may be heat-treated for any period of time. The heat-treatment period is appropriately determined in consideration of the productivity or the amount of the powder to be treated. The heat-treatment period is preferably within five hours for maintaining the productivity.

The heat-treatment step is preferably performed under vacuum or in an inert gas atmosphere for preventing oxidation. The heat-treatment may be performed in a nitrogen atmosphere in view of surface treatment of the powder. The heat-treatment in a nitrogen atmosphere, however, may cause an increase in coercive force, resulting in magnetic permeability lower than that in the case of heat-treatment under vacuum.

The heat-treatment under vacuum or in an argon or nitrogen atmosphere repairs lattice defects generated in the powder flattened with an attritor to recover the magnetic permeability. The heat-treatment in air causes oxidation and fails to produce the powder of the present invention. Thus, the heat-treatment needs to be performed under vacuum or an inert gas atmosphere. The heat-treatment in a nitrogen atmosphere can form a nitride coating to provide the powder with high surface resistance. The use of the powder can reduce the occurrence of eddy currents and can improve the performance of an antenna for 10 MHz or thereabouts (e.g., an antenna for RFID).

The flaky soft magnetic powder of the present invention satisfies the aforementioned ratio of the average particle size $D_{50}$ to the tap density TD ($D_{50}$/TD) and the aforementioned coercive force as measured under application of a magnetic field in an in-plane direction of the flaky powder. In some cases, surface-treated flaky powder is desired for improving the insulation of the sheet formed from the powder. Thus, a surface treatment step may optionally be added before, during, or after the heat-treatment step. For example, the heat-treatment may be performed in an atmosphere containing a small amount of active gas for surface treatment of the powder.

The flaky powder may be subjected to a traditional surface treatment using a cyan coupling agent for improving the corrosion resistance of the powder or the dispersibility of the powder in rubber. A magnetic sheet can be produced from the flaky powder by any traditional process. For example, the flaky powder is mixed with a solution of chlorinated polyethylene in toluene, the mixture is applied to a substrate and then dried, and the resultant product is compressed with any press or roll, to produce a magnetic sheet.

EXAMPLES

The present invention will now be described in more detail by way of examples.

(1) Preparation of Flaky Soft Magnetic Powder

Powder having a predetermined composition was prepared by any process selected from water atomization, gas atomization, disk atomization, and grinding after melt-alloying, and then subjected to classification, to prepare raw material powder having a particle size of 150 μm or less. In the gas atomization process, an alloy was melted in an alumina crucible, the molten alloy was discharged through a nozzle (diameter: 5 mm) disposed below the crucible, and high-pressure argon gas was sprayed to the molten alloy. In the disk atomization process, an alloy was melted in an alumina crucible, the molten alloy was discharged through a nozzle (diameter: 1 to 5 mm) disposed below the crucible, and the molten alloy was dropped onto a disk rotating at a high rate. The rotation rate of the disk was adjusted to 40,000 rpm to 60,000 rpm. The molten alloy was quenched and solidified by the disk to prepare powder.

The resultant raw material powder was then flattened with an attritor. In the flattening process with an attritor, SUJ2 balls (diameter: 4.8 mm) were placed in an agitation vessel, the raw material powder and industrial ethanol were added to the agitation vessel, and an agitation blade was rotated at 300 rpm. The industrial ethanol was added in an amount of 200 to 500 parts by mass relative to 100 parts by mass of the raw material powder. No flattening aid was used, or a flattening aid was added in an amount of 1 to 5 parts by mass relative to 100 parts by mass of the raw material powder. The flattened powder and the industrial ethanol were removed from the agitation vessel and transferred to a stainless steel dish, followed by drying at 80° C. for 24 hours. The flattened powder was heat-treated under vacuum or in an argon or nitrogen atmosphere at 200 to 500° C. for two hours, to produce a flaky soft magnetic powder. The flaky soft magnetic powder was evaluated for the properties described below. Tables 1 and 2 illustrate detailed conditions for preparation of the flaky powder.

(2) Evaluation of Flaky Soft Magnetic Powder

The resultant flaky powder was evaluated for average particle size, tap density, coercive force, and magnetic permeability. The average particle size and the true density were determined by laser diffractometry and the gas replacement method, respectively. For evaluation of the tap density, the flaky powder (about 20 g) was placed in a cylinder (volume: 100 $cm^3$), and the filling density was determined under the following conditions (drop height: 10 mm, tapping: 200 times). For determination of the coercive force, the flaky powder was placed in a cylindrical resin container having a diameter of 6 mm and a height of 8 mm, and was subjected to the measurement under magnetization in a height direction and a diametrical direction of the container. Since the thickness direction of the flaky powder corresponds to the height direction of the cylindrical container, the coercive force of the flaky powder in a thickness direction is determined under magnetization in the height direction of the container, and the coercive force of the flaky powder in an in-plane direction is determined under magnetization in the diametrical direction of the container. The coercive force was determined under application of a magnetic field of 144 kA/m.

(3) Preparation and Evaluation of Magnetic Sheet

Chlorinated polyethylene was dissolved in toluene, and the flaky powder was dispersed in the solution. The resultant dispersion was applied to a polyester resin (coating thickness: about 100 μm) and dried at ambient temperature and humidity, followed by pressing at 130° C. and 15 MPa, to prepare a magnetic sheet having dimensions of 150 mm by 150 mm by 50 μm (thickness). The volumetric filling ratio of the flaky powder in the magnetic sheet was about 50%. The magnetic sheet was then cut into a toroidal piece having an outer diameter of 7 mm and an inner diameter of 3 mm. The impedance of the piece was measured with an impedance meter at room temperature and 13.56 MHz. The magnetic permeability (real part of complex magnetic permeability: μ', imaginary part of complex magnetic permeability: μ") was calculated on the basis of the measured impedance.

The present invention should not be limited to the above-described examples. The results of evaluation are illustrated in Tables 1 and 2.

TABLE 1

| No | Raw material powder composition (mass %) | Preparation of raw material powder | Rotation rate of attritor (rpm) | Attrition time (h) | Heat-treatment temperature (° C.) | Heat-treatment atmosphere | Average particle size $D_{50}$ (μm) | Ratio of average particle size $D_{50}$ to tap density TD: $D_{50}$/TD | Aspect ratio of flaky powder |
|---|---|---|---|---|---|---|---|---|---|
| 1 | Fe—9.5Si—5.5Al | GA | 450 | 3 | 300 | Ar | 30 | 20 | 2 |
| 2 | Fe—9.5Si—5.5Al | GA | 450 | 5 | 300 | Ar | 32 | 26 | 4 |
| 3 | Fe—9.5Si—5.5Al | GA | 450 | 10 | 300 | Ar | 36 | 33 | 5 |
| 4 | Fe—9.5Si—5.5Al | GA | 450 | 12 | 300 | Ar | 41 | 40 | 9 |
| 5 | Fe—9.5Si—5.5Al | GA | 450 | 15 | 300 | Ar | 46 | 57 | 15 |
| 6 | Fe—9.5Si—5.5Al | GA | 450 | 20 | 300 | Ar | 53 | 88 | 29 |
| 7 | Fe—9.5Si—6.0Al | GA | 450 | 3 | 300 | Ar | 35 | 22 | 3 |
| 8 | Fe—9.5Si—6.0Al | GA | 450 | 5 | 300 | Ar | 41 | 28 | 5 |
| 9 | Fe—9.5Si—6.0Al | GA | 450 | 10 | 300 | Ar | 45 | 30 | 8 |
| 10 | Fe—9.5Si—6.0Al | GA | 450 | 12 | 300 | Ar | 46 | 43 | 11 |
| 11 | Fe—9.5Si—6.0Al | GA | 450 | 15 | 300 | Ar | 51 | 55 | 20 |
| 12 | Fe—9.5Si—6.0Al | GA | 450 | 22 | 300 | Ar | 55 | 90 | 31 |
| 13 | Fe—9.5Si—6.5Al | GA | 450 | 3 | 400 | Ar | 36 | 18 | 3 |
| 14 | Fe—9.5Si—6.5Al | GA | 450 | 5 | 400 | Ar | 40 | 30 | 6 |
| 15 | Fe—9.5Si—6.5Al | GA | 450 | 10 | 400 | Ar | 47 | 45 | 10 |
| 16 | Fe—9.5Si—6.5Al | GA | 450 | 12 | 400 | Ar | 50 | 43 | 11 |
| 17 | Fe—9.5Si—6.5Al | GA | 450 | 15 | 400 | Ar | 55 | 59 | 15 |
| 18 | Fe—9.5Si—6.5Al | GA | 450 | 22 | 400 | Ar | 57 | 95 | 28 |
| 19 | Fe—6.5Si—6.0Al | GA | 300 | 15 | 100 | Vacuum | 31 | 60 | 11 |
| 20 | Fe—6.5Si—6.0Al | GA | 300 | 15 | 200 | Vacuum | 35 | 55 | 18 |
| 21 | Fe—6.5Si—6.0Al | GA | 300 | 15 | 300 | Vacuum | 44 | 58 | 30 |
| 22 | Fe—6.5Si—6.0Al | GA | 300 | 15 | 400 | Vacuum | 33 | 54 | 12 |
| 23 | Fe—6.5Si—6.0Al | GA | 300 | 15 | 500 | Vacuum | 41 | 57 | 15 |
| 24 | Fe—6.5Si—6.0Al | GA | 300 | 15 | 600 | Vacuum | 45 | 60 | 27 |
| 25 | Fe—6.5Si—6.0Al | GA | 300 | 15 | 800 | Vacuum | 35 | 62 | 15 |
| 26 | Fe—6.5Si—6.0Al | GA | 300 | 15 | 400 | $N_2$ | 39 | 58 | 19 |
| 27 | Fe—5.5Si—6.0Al | GA | 300 | 15 | 400 | Vacuum | 47 | 54 | 23 |
| 28 | Fe—10.5Si—7.0Al | GA | 300 | 15 | 400 | Vacuum | 40 | 54 | 13 |
| 29 | Fe—6.5Si—4.5Al | GA | 300 | 15 | 400 | $N_2$ | 50 | 55 | 19 |
| 30 | Fe—6.5Si—8.0Al | GA | 300 | 15 | 400 | $N_2$ | 55 | 60 | 23 |

| No | Thickness of flaky powder (μm) | Oxygen content (mass %) | Nitrogen content (ppm) | Coercive force in in-plane direction (A/m) | Ratio of coercive force in thickness direction to coercive force in in-plane direction | Half width of strongest XRD peak (2θ = 44 ±2°) | Real part of complex magnetic permeability of sheet (μ') | Imaginary part of complex magnetic permeability of sheet (μ") | Ratio of complex magnetic permeability of sheet tan δ (μ"/μ') |
|---|---|---|---|---|---|---|---|---|---|
| 1 | 18 | 0.06 | 15 | 240 | 1.25 | 0.30 | 65 | 12 | 0.185 |
| 2 | 6.2 | 0.11 | 20 | 260 | 1.54 | 0.35 | 92 | 20 | 0.217 |
| 3 | 4.5 | 0.12 | 19 | 290 | 1.85 | 0.36 | 108 | 25 | 0.231 |
| 4 | 3.1 | 0.15 | 20 | 320 | 2.00 | 0.38 | 115 | 18 | 0.157 |
| 5 | 2.5 | 0.22 | 22 | 365 | 2.70 | 0.42 | 112 | 20 | 0.179 |
| 6 | 1.5 | 0.37 | 38 | 405 | 2.23 | 0.45 | 100 | 22 | 0.220 |
| 7 | 16 | 0.05 | 18 | 142 | 1.15 | 0.28 | 85 | 23 | 0.271 |

TABLE 1-continued

| | | | | | | | | | |
|---|---|---|---|---|---|---|---|---|---|
| 8 | 5.9 | 0.09 | 21 | 158 | 1.38 | 0.32 | 120 | 21 | 0.175 |
| 9 | 4.7 | 0.11 | 22 | 185 | 2.49 | 0.37 | 128 | 19 | 0.148 |
| 10 | 2.9 | 0.12 | 21 | 210 | 2.50 | 0.40 | 145 | 32 | 0.221 |
| 11 | 2.5 | 0.2 | 25 | 250 | 3.70 | 0.41 | 132 | 18 | 0.136 |
| 12 | 1.3 | 0.34 | 40 | 283 | 2.42 | 0.39 | 102 | 8 | 0.076 |
| 13 | 9 | 0.05 | 14 | 140 | 0.85 | 0.30 | 70 | 15 | 0.214 |
| 14 | 5.8 | 0.12 | 18 | 155 | 1.90 | 0.32 | 102 | 20 | 0.196 |
| 15 | 3.4 | 0.15 | 20 | 195 | 1.84 | 0.34 | 110 | 22 | 0.200 |
| 16 | 2.1 | 0.14 | 23 | 208 | 2.70 | 0.40 | 140 | 28 | 0.200 |
| 17 | 1.9 | 0.24 | 27 | 260 | 4.50 | 0.38 | 142 | 13 | 0.092 |
| 18 | 1.4 | 0.35 | 39 | 370 | 2.00 | 0.35 | 113 | 24 | 0.212 |
| 19 | 3.4 | 0.30 | 25 | 209 | 1.20 | 0.71 | 66 | 12 | 0.182 |
| 20 | 2.2 | 0.31 | 28 | 250 | 2.10 | 0.50 | 120 | 14 | 0.117 |
| 21 | 1.5 | 0.24 | 24 | 245 | 2.50 | 0.40 | 110 | 13 | 0.118 |
| 22 | 3.2 | 0.26 | 25 | 242 | 3.0 | 0.38 | 108 | 11 | 0.102 |
| 23 | 2.5 | 0.28 | 26 | 217 | 2.4 | 0.36 | 110 | 17 | 0.155 |
| 24 | 1.5 | 0.29 | 28 | 198 | 2.1 | 0.24 | 120 | 19 | 0.158 |
| 25 | 2 | 0.27 | 28 | 200 | 2.4 | 0.14 | 140 | 22 | 0.157 |
| 26 | 2.2 | 0.31 | 5000 | 229 | 1.80 | 0.35 | 124 | 18 | 0.145 |
| 27 | 2.1 | 0.57 | 31 | 440 | 2.10 | 0.32 | 90 | 12 | 0.133 |
| 28 | 2.3 | 0.32 | 29 | 286 | 2.41 | 0.27 | 120 | 11 | 0.092 |
| 29 | 2.2 | 0.33 | 6400 | 310 | 2.4 | 0.35 | 110 | 14 | 0.127 |
| 30 | 2.1 | 0.62 | 35 | 500 | 3.0 | 0.33 | 97 | 13 | 0.134 |

Note 1)
GA: gas atomization
Note 2)
DA: disk atomization
Note 3)
WA: water atomization
Note 4)
Underlined numerals fall outside the scope of the present invention

TABLE 2

| No | Raw material powder composition (mass %) | Preparation of raw material powder | Rotation rate of attritor (rpm) | Attrition time (h) | Heat-treatment temperature (° C.) | Heat-treatment atmosphere | Average particle size $D_{50}$ (μm) | Ratio of average particle size $D_{50}$ to tap density TD: $D_{50}$/TD | Aspect ratio of flaky powder |
|---|---|---|---|---|---|---|---|---|---|
| 31 | Fe—3Si | GA | 450 | 15 | 400 | Ar | 47 | 30 | 32 |
| 32 | Fe—3Si | GA | 450 | 20 | 400 | Ar | 40 | 32 | 30 |
| 33 | Fe—6Si | GA | 450 | 15 | 400 | Ar | 44 | 35 | 36 |
| 34 | Fe—6Si | GA | 450 | 20 | 400 | Ar | 40 | 37 | 38 |
| 35 | Fe—10Si | GA | 450 | 15 | 400 | Ar | 43 | 33 | 33 |
| 36 | Fe—10Si | GA | 450 | 20 | 400 | Ar | 40 | 35 | 35 |
| 37 | Fe—10Si—2Cr | GA | 450 | 10 | 400 | Ar | 55 | 52 | 28 |
| 38 | Fe—10Si—2Cr | DA | 300 | 10 | 400 | Vacuum | 53 | 50 | 30 |
| 39 | Fe—10Si—2Cr | WA | 180 | 10 | 400 | Air | 57 | 57 | 22 |
| 40 | Fe—10Si—5Cr | GA | 450 | 10 | 300 | Ar | 52 | 60 | 31 |
| 41 | Fe—10Si—5Cr | DA | 300 | 10 | 300 | Vacuum | 55 | 58 | 25 |
| 42 | Fe—10Si—5Cr | WA | 180 | 10 | 300 | Air | 56 | 58 | 32 |
| 43 | Fe—4.5Si—3.5Al | GA | 450 | 15 | 400 | Ar | 35 | 55 | 30 |
| 44 | Fe—4.5Si—9.0Al | GA | 450 | 15 | 400 | Vacuum | 40 | 52 | 28 |
| 45 | Fe—11.5Si—3.5Al | GA | 450 | 15 | 400 | Ar | 28 | 60 | 25 |
| 46 | Fe—11.5Si—9.0Al | GA | 450 | 15 | 400 | Vacuum | 30 | 58 | 30 |

| No | Thickness of flaky powder (μm) | Oxygen content (mass %) | Nitrogen content (ppm) | Coercive force in in-plane direction (A/m) | Ratio of coercive force in thickness direction to coercive force in in-plane direction | Half width of strongest XRD peak (2θ = 44 ±2°) | Real part of complex magnetic permeability of sheet (μ') | Imaginary part of complex magnetic permeability of sheet (μ'') | Ratio of complex magnetic permeability of sheet tan δ (μ''/μ') |
|---|---|---|---|---|---|---|---|---|---|
| 31 | 1.9 | 0.32 | 25 | 1100 | 1.90 | 0.41 | 120 | 20 | 0.167 |
| 32 | 1.3 | 0.41 | 22 | 1200 | 1.50 | 0.36 | 105 | 21 | 0.200 |
| 33 | 1.5 | 0.35 | 23 | 1450 | 1.30 | 0.40 | 123 | 25 | 0.203 |
| 34 | 1.6 | 0.44 | 19 | 1400 | 1.50 | 0.44 | 120 | 23 | 0.192 |
| 35 | 0.9 | 0.34 | 24 | 1600 | 1.44 | 0.36 | 125 | 22 | 0.176 |
| 36 | 1.2 | 0.39 | 25 | 1650 | 1.30 | 0.39 | 130 | 27 | 0.208 |
| 37 | 2.4 | 0.15 | 20 | 280 | 3.4 | 0.35 | 130 | 24 | 0.185 |

TABLE 2-continued

| | | | | | | | | | |
|---|---|---|---|---|---|---|---|---|---|
| 38 | 2 | 0.12 | 17 | 300 | 3.4 | 0.38 | 135 | 30 | 0.222 |
| 39 | 1.8 | 0.72 | 30 | 310 | 2.5 | 0.38 | 124 | 24 | 0.194 |
| 40 | 2.4 | 0.17 | 15 | 300 | 2.7 | 0.41 | 110 | 17 | 0.155 |
| 41 | 2.3 | 0.15 | 17 | 350 | 2.8 | 0.44 | 128 | 18 | 0.141 |
| 42 | 1.8 | 0.59 | 37 | 400 | 2.9 | 0.48 | 130 | 15 | 0.115 |
| 43 | 2.1 | 0.14 | 30 | 950 | 1.8 | 0.44 | 70 | 15 | 0.214 |
| 44 | 2.3 | 0.16 | 35 | 1080 | 2.0 | 0.50 | 94 | 22 | 0.234 |
| 45 | 1.8 | 0.15 | 36 | 1050 | 2.0 | 0.47 | 95 | 25 | 0.263 |
| 46 | 1.7 | 0.17 | 34 | 1540 | 1.8 | 0.51 | 85 | 18 | 0.212 |

Note 1)
GA: gas atomization
Note 2)
DA: disk atomization
Note 3)
WA: water atomization
Note 4)
Underlined numerals fall outside the scope of the present invention As illustrated in Tables 1 and 2, Nos. 4 to 6, 11, 12, 17, 20 to 22, and 27 to 29 correspond to Examples of the present invention, and Nos. 1 to 3, 7 to 10, 13 to 16, 18, 19, 23 to 26, and 31 to 46 correspond to Comparative Examples.

With reference to Tables 1 and 2, in Comparative Example Nos. 1 and 2, the average particle size $D_{50}$ is small, and the aspect ratio of the flaky powder is low, resulting in low magnetic permeability of the magnetic sheet. In addition, the ratio of the average particle size $D_{50}$ to the tap density TD is low, and the ratio of the coercive force in the thickness direction to that in the in-plane direction is less than 2, resulting in low magnetic permeability. In Comparative Example No. 3, the ratio of the average particle size $D_{50}$ to the tap density TD is low, and the ratio of the coercive force in the thickness direction to that in the in-plane direction is less than 2, resulting in low magnetic permeability.

In Comparative Example No. 7, the ratio of the average particle size $D_{50}$ to the tap density TD is low, the coercive force in the in-plane direction is low, and thus the imaginary part μ' of complex magnetic permeability is large in a low-frequency band, resulting in increased energy loss. The ratio of the coercive force in the thickness direction to that in the in-plane direction is less than 2, resulting in low magnetic permeability. In addition, the half width of the strongest XRD peak (2θ=44±2°) is less than 0.3°, which indicates excessive heat-treatment of the flattened powder. This results in very low coercive force Hc. Thus, the imaginary part μ" of complex magnetic permeability is large, and energy loss increases.

In Comparative Example No. 8 (similar to the case of No. 7), the ratio of the average particle size $D_{50}$ to the tap density TD is low, the coercive force in the in-plane direction is low, and thus the imaginary part μ" of complex magnetic permeability is large in a low-frequency band, resulting in increased energy loss. The ratio of the coercive force in the thickness direction to that in the in-plane direction is less than 2, resulting in low magnetic permeability. In Comparative Example No. 9, the ratio of the average particle size $D_{50}$ to the tap density TD is low, the coercive force in the in-plane direction is low, and thus the imaginary part μ" of complex magnetic permeability is large in a low-frequency band, resulting in increased energy loss. In Comparative Example 10, the coercive force in the in-plane direction is low, and thus the imaginary part μ" of complex magnetic permeability is large in a low-frequency band, resulting in increased energy loss.

In Comparative Example Nos. 13 and 14, the ratio of the average particle size $D_{50}$ to the tap density TD is low, the coercive force in the in-plane direction is low, and thus the imaginary part μ" of complex magnetic permeability is large in a low-frequency band, resulting in increased energy loss. The ratio of the coercive force in the thickness direction to that in the in-plane direction is less than 2, resulting in low magnetic permeability. In Comparative Example No. 15, the coercive force in the in-plane direction is low, and thus the imaginary part μ" of complex magnetic permeability is large in a low-frequency band, resulting in increased energy loss. The ratio of the coercive force in the thickness direction to that in the in-plane direction is less than 2, resulting in low magnetic permeability. In Comparative Example No. 16, the coercive force in the in-plane direction is low, and thus the imaginary part μ" of complex magnetic permeability is large in a low-frequency band, resulting in increased energy loss.

In Comparative Example No. 18, the ratio of the average particle size $D_{50}$ to the tap density TD is high, and the average particle size $D_{50}$ is large, probably resulting in poor formability of the magnetic sheet. In Comparative Example No. 19, the average particle size $D_{50}$ is small, and thus the aspect ratio of the flaky powder is low, resulting in low magnetic permeability during formation of the magnetic sheet. The coercive force in the in-plane direction is low, and thus the imaginary part μ" of complex magnetic permeability is large in a low-frequency band, resulting in increased energy loss. The ratio of the coercive force in the thickness direction to that in the in-plane direction is less than 2, resulting in low magnetic permeability. In addition, the half width of the strongest XRD peak (2θ=44±2°) exceeds 0.6°, which indicates insufficient recovery of lattice defects generated in the powder flattened with an attritor. This results in a small imaginary part μ" and unsatisfactory performance of an antenna.

In Comparative Example No. 23, the coercive force in the in-plane direction is low, and thus the imaginary part μ" of complex magnetic permeability is large in a low-frequency band, resulting in increased energy loss. In Comparative Example No. 24, the coercive force in the in-plane direction is low, and thus the imaginary part μ" of complex magnetic permeability is large in a low-frequency band, resulting in increased energy loss. In addition, the half width of the strongest XRD peak (2θ=44±2°) is less than 0.3°, which indicates excessive heat-treatment of the flattened powder. This results in very low coercive force Hc. Thus, the imaginary part μ" of complex magnetic permeability is large, and energy loss increases.

In Comparative Example No. 25 (similar to the case of No. 24), the coercive force in the in-plane direction is low, and thus the imaginary part μ" of complex magnetic permeability is large in a low-frequency band, resulting in increased energy loss. In addition, the half width of the strongest XRD peak (2θ=44±2°) is less than 0.3°, which indicates excessive heat-treatment of the flattened powder. This results in very low coercive force Hc. Thus, the imaginary part μ" of complex magnetic permeability is large, and energy loss increases.

In Comparative Example No. 26, the coercive force in the in-plane direction is low, and thus the imaginary part μ" of complex magnetic permeability is large in a low-frequency band, resulting in increased energy loss. The ratio of the coercive force in the thickness direction to that in the in-plane direction is less than 2, resulting in low magnetic permeability. In Comparative Example Nos. 31, 32, and 35, the ratio of the average particle size $D_{50}$ to the tap density TD is low, the coercive force Hc in the in-plane direction exceeds 479 A/m, and thus the real part μ' of complex magnetic permeability is small, resulting in poor performance of an antenna. In addition, the ratio of the coercive force in the thickness direction to that in the in-plane direction is less than 2, resulting in low magnetic permeability. In Comparative Example Nos. 33, 34, and 36, the coercive force Hc in the in-plane direction exceeds 479 A/m, and thus the real part μ' of complex magnetic permeability is small, resulting in poor performance of an antenna. In addition, the ratio of the coercive force in the thickness direction to that in the in-plane direction is less than 2, resulting in low magnetic permeability. Comparative Example Nos. 37 to 42 correspond to the case of comparison between different Fe—Si—Cr alloys. Comparative Example Nos. 43 and 44 correspond to the case of low Si content and low and high Al contents. In each of Comparative Example Nos. 43 and 44, the magnetic permeability of the resultant magnetic sheet is low. Comparative Example Nos. 45 and 46 correspond to the case of high Si content and low and high Al contents. In each of Comparative Example Nos. 45 and 46, the magnetic permeability of the resultant magnetic sheet is low. In contrast, satisfactory effects are achieved in the flaky powders of Example Nos. 4 to 6, 11, 12, 17, 20 to 22, and 27 to 29, which satisfy the conditions of the present invention.

As described above, the real part μ' of magnetic permeability is large and the imaginary part μ" of magnetic permeability is small at 10 MHz or thereabouts (e.g., for RFID) if the ratio of the average particle size $D_{50}$ to the tap density TD ($D_{50}$/TD) is 35 to 92 and the coercive force as measured under application of a magnetic field in the in-plane direction is 239 to 479 A/m. If the coercive force in the thickness direction is 2 to 4.5 times that in the in-plane direction, sufficiently high complex magnetic permeability is achieved, and the formation of protrusions is reduced on the surface of the magnetic sheet. In the case where the half width of the strongest XRD peak (2θ=44±2°) is 0.3 to 0.6°, superior effects (e.g., high complex magnetic permeability) are obtained.

The invention claimed is:

1. A flaky soft magnetic powder comprising an Fe—Si—Al alloy containing Si: 5.5 to 10.5 mass %, Al: 5.5 to 8.0 mass %, and Fe and incidental impurities: balance, wherein the flaky powder exhibits a ratio ($D_{50}$/TD) of 40 to 92 where $D_{50}$ represents the average particle size (μm) of the powder and TD represents the tap density (Mg/$m^3$) of the powder, and the flaky powder exhibits a coercive force of 239 to 479 A/m as measured under application of a magnetic field in an in-plane direction of the flaky powder.

2. The flaky soft magnetic powder according to claim 1, wherein the coercive force as measured under application of a magnetic field in a thickness direction of the flaky powder is 2 to 4.5 times the coercive force as measured under application of a magnetic field in an in-plane direction of the flaky powder.

3. The flaky soft magnetic powder according to claim 1, wherein the flaky powder exhibits a half width of the strongest XRD peak (2θ=44±2°) of 0.3 to 0.6°.

4. A method of producing the flaky soft magnetic powder according to claim 1, the method comprising the steps of:

preparing a raw material powder by any process selected from water atomization, gas atomization, disk atomization, and grinding after melt-alloying;

flattening the raw material powder; and heat-treating the flattened powder at 200 to 500° C. under vacuum or in an argon or nitrogen atmosphere.

5. The flaky soft magnetic powder according to claim 1, wherein the flaky powder exhibits a ratio ($D_{50}$/TD) of 55 to 92.

* * * * *